US007422480B1

(12) United States Patent
Musick et al.

(10) Patent No.: US 7,422,480 B1
(45) Date of Patent: Sep. 9, 2008

(54) SHIELDED ELECTRIC CONNECTOR AND CABLE ASSEMBLY AND METHOD FOR MAKING SAME

(75) Inventors: Steven A. Musick, Burton, OH (US); Frederick E. Mlakar, Hermitage, PA (US); Frederick D. Esenwein, Canfield, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/788,521

(22) Filed: Apr. 20, 2007

(51) Int. Cl.
*H01R 9/05* (2006.01)

(52) U.S. Cl. ..... 439/585; 439/879

(58) Field of Classification Search ..... 439/877, 439/879, 578, 585

See application file for complete search history.

(56) References Cited

U.S. PATENT DOCUMENTS 6,257,931 B1 7/2001 Sakurai et al.
6,808,417 B2 * 10/2004 Yoshida ..... 439/585
7,160,150 B2 1/2007 Annequin

* cited by examiner

*Primary Examiner*—Ross N Gushi
(74) *Attorney, Agent, or Firm*—David P. Wood

(57) ABSTRACT

A shielded electric cable assembly comprises a shielded electric cable and a shielded electric connector that has an inner terminal, an insulator and an outer shielding terminal. The inner terminal has an attachment portion that is supported on a projecting anvil of the insulator that is disposed in an intermediate bay of the outer shielding terminal. The bay has an opening for a crimp tool that crimps the attachment portion of the inner terminal onto an exposed end of a conductive core of the shielded electric cable. The intermediate bay is closed by side wall flaps of the intermediate bay or by a closure shell. The crimp tool that may be part of the insulator.

17 Claims, 3 Drawing Sheets

SHIELDED ELECTRIC CONNECTOR AND CABLE ASSEMBLY AND METHOD FOR MAKING SAME

BACKGROUND OF THE INVENTION

This invention relates generally to a shielded electric connector a shielded electric cable assembly and a method of making a shielded electric cable assembly.

A shielded electric cable assembly generally comprises a shielded electric cable, that has a conductor core that is surrounded by an inner insulation jacket, an intermediate conductive layer, and an outer insulation jacket. An inner terminal is attached to the conductor core as part of the assembly for making an electric connection to a mating terminal and a shield terminal is attached to the conductive layer. The conductive layer and shield terminal shield any electronic devices in the vicinity of the shielded electric cable assembly from electromagnetic interference (generally designated EMI) caused by electric current flowing through the conductive core and inner terminal.

A common shielded electric cable has an intermediate conductive layer in the form of a metallic braid that is woven around the inner insulation jacket. Terminals that include core crimp wings for attaching a terminal to the conductor core of an electric cable by a crimping operation are well known. Likewise terminals that include both core and insulation crimp wings for attaching a terminal to both the core and insulation jacket of an electric cable are also well known.

U.S. Pat. No. 6,257,931 B1 issued to Kazuaki Sakurai et al. Jul. 10, 2001, discloses a shielded electric cable assembly in FIG. 1. The shielded electric cable assembly comprises a shielded electric cable and an inner terminal that is attached to an exposed end portion of a conductor core of the shielded electric cable by core crimp wings to form an inner member sub-assembly as shown in FIG. 3 of the Sakurai et al. patent. The shielded electric cable assembly also includes an outer terminal sub-assembly comprising an inner insulating housing inside an outer or shielding terminal as shown in FIG. 4. The inner sub-assembly is connected to the outer sub-assembly by inserting inner terminal into the inner insulating housing of the outer terminal sub-assembly as shown in FIG. 1. The shielding terminal is then attached to the shielded electric cable by two sets of crimp wings that are crimped around the exposed end of the conductive layer and the outer insulation jacket of the shielded electric cable as shown in FIG. 8. The shielding terminal includes an integral lid member that is pressed against the conductive layer of the shielded electric cable to close an opening at the rear of the shielding terminal after the inner terminal is inserted into the inner insulating housing.

The shielded electric cable assembly disclosed in the Sakurai et al. patent is expensive and difficult to manufacture primarily because it involves the fabrication of two separate sub-assemblies that must be attached to the electric cable at different times, namely an inner terminal sub-assembly that is attached to the cable and an outer or shielding terminal sub-assembly which must be joined to the inner sub-assembly and then attached to the cable.

U.S. Pat. No. 7,160,150 B2 issued to Sebastien Annequin Jan. 9, 2007 discloses a shielded electric cable assembly that does not require an initial subassembly attached to the shielded electric cable. The shielded electric cable assembly disclosed in the Annequin patent has an electric connector that is attached to a shielded electric cable assembly in a single operation or series of operations. The electric connector comprises an outer body, an insulating body and a central contact (inner terminal). Central contact has a forward portion is disposed inside the insulating body and a protruding rearward portion equipped with core crimp wings that are supported on an integral extending bearing portion of the insulating body. After the shielded electric cable is prepared as shown in FIG. 2 of the Annequin patent, the electric connector is attached to the bared end of the core of the shielded electric cable in a crimping operation as shown in FIGS. 6, 7 and 8 of the Annequin patent. The electric connector is also attached to the bared end of the conductive layer and the end of the insulation jacket of the shielded electric cable by braid crimp wings and insulation crimp wings respectively; the braid crimp wings and insulation crimp wings being part of the shielding terminal. The Annequin patent does not specify when the braid and insulation crimp wings are crimped.

While the U.S. Pat. No. 7,160,150 B2 does disclose a shielded electric cable assembly that can be fabricated in an easier manner, the Annequin shielded cable assembly nevertheless has a draw back in that the shielded electric cable assembly has a large opening in the shielding terminal that exposes the core crimp wings of the inner terminal thus compromising the shielding efficiency of the arrangement.

SUMMARY OF THE INVENTION

In one aspect the invention provides a shielded electric connector that includes an outer shielding terminal that has an open bay for receiving a bared core end of a shielded electric cable on an anvil in the open bay that supports core crimp wings of an inner terminal. The anvil is part of an insulator in the outer terminal that includes a crimp tool for crimping the core crimp wings of the inner terminal to the bared core end of the shielded electric cable. The open bay may include at least one side wall flap for assisting in the crimping operation and enclosing the bay around the core crimp wings.

In another aspect the invention provides an shielded electric cable assembly comprising a shielded electric cable and a shielded electric connector that has an inner terminal, an insulator and an outer shielding terminal. The inner terminal has a rearward attachment portion that includes core crimp wings that are attached to a bared core end of the shielded electric cable. The insulator has a projecting rearward anvil that that projects from a rearward end of a forward housing. The rearward attachment end of the inner terminal is supported on the rearward anvil of the insulator. The rearward attachment end of the inner terminal and the rearward anvil of the insulator are disposed in an intermediate bay of the outer terminal. The intermediate bay of the outer terminal has an opening for receiving a crimp tool and the shielded electric cable assembly includes structure for closing the opening which may be in the form of a side wall flap or flaps or a closure shell.

The crimp tool may be attached to the rearward end of the insulator housing by a hinge.

The rearward attachment end of the outer terminal may also include forward crimp wings attached to an intermediate conductive layer of the co-axial cable and rearward crimp wings attached to an outer insulation jacket of the co-axial cable.

In yet another aspect the invention provides a method for making a shielded electric cable assembly having a shielded electric connector attached to an end of a shielded electric cable. In the method a shielded electric connector having an inner terminal, an insulator and an outer shielding terminal is provided. The inner terminal has a rearward attachment portion that includes core crimp wings and the insulator has a rearward anvil that that projects from a rearward end of a forward housing, and a crimp tool that is attached to the rearward end of the forward housing by a hinge. The rearward attachment end of the inner terminal is supported on the rearward anvil of the insulator and disposed in an intermediate open bay of the outer shielding terminal. In the method an exposed end portion of the conductive core of the coaxial cable is supported on the rearward attachment portion of the inner terminal, and the crimp tool of the insulator is placed on the core crimp wings of the inner terminal and used to crimp the core crimp wings to the conductive core.

The intermediate bay of the outer shielding terminal may include at least one side wall flap that is moved from an open position to a closed position to enclose the crimp tool in the bay of the outer terminal. Alternatively the shielded cable assembly may include a moveable closure shell for enclosing the crimp tool in the bay.

The method may include additional steps to attach the outer shielding terminal to an intermediate conductive layer and to an outer insulation jacket of the shielded electric cable.

DETAILED DESCRIPTION OF PREFERRED EMBODIMENTS

Figure 1:
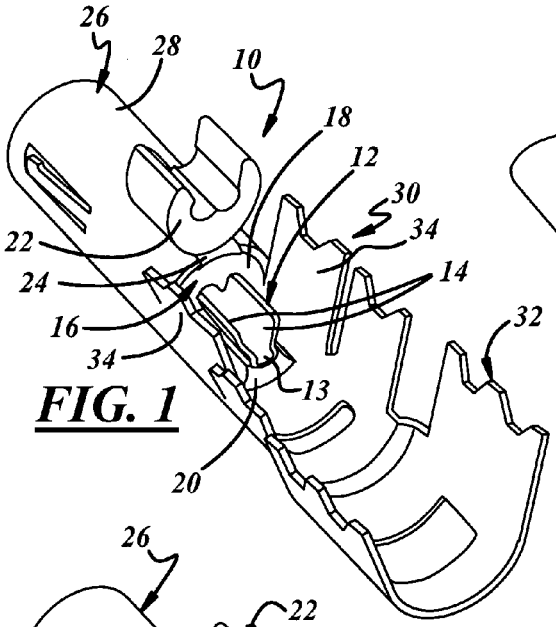
FIG. 1 is a perspective view a shielded electric connector that embodies the invention.

Referring now to the drawing, FIG. 1 shows a shielded electric connector 10 comprising an inner terminal 12 having a forward contact portion (not shown) and a rearward attachment portion 13 that includes core crimp wings 14. The shielded electric connector 10 further comprises an insulator 16 having a forward housing 18 for the forward contact portion of the inner terminal 12 and a rearward anvil 20 that that projects from a rearward end of the housing 18 in a fixed manner. Insulator 16 has a crimp tool 22 that is integrally attached to the rearward end of the housing 18 by a flexible hinge strap 24.

The forward contact portion of the inner terminal 12 is disposed in the forward housing 18 of the insulator 16 with the rearward attachment portion 13 of the inner terminal 12 supported on the projecting rearward anvil 20 of the insulator 16 as best shown in FIG. 1. The shielded electric connector 10 also includes an outer shielding terminal 26 that has a forward housing 28, an intermediate bay 30, and a rearward attachment portion 32. The forward housing 18 of the insulator 16 is disposed in the forward housing 28 of the outer shielding terminal 26 with the rearward attachment portion 13 of the inner terminal 12 and the projecting rearward anvil 20 of insulator 16 located in the intermediate bay 30 of the outer shielding terminal 26. The intermediate bay 30 of the outer shielding terminal 26 is generally U-shaped with side wall flaps 34. The side wall flaps 34 initially provide an opening for receiving the crimp tool 22 of the insulator 32 and ultimately form a closure for enclosing the crimp tool 22 in the intermediate bay 30 as explained below.

Figure 2:
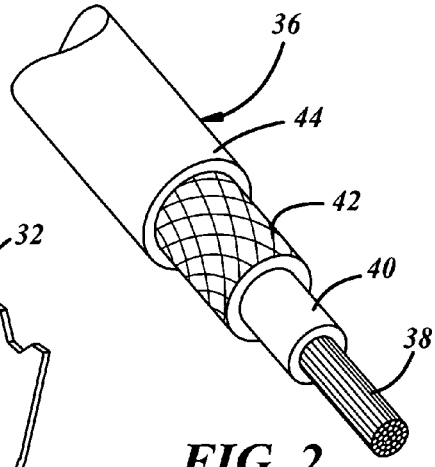
FIG. 2 is a perspective view of an end of a shielded electric cable that has been prepared for a shielded electric cable assembly that embodies the invention.

FIG. 2 illustrates a conventional shielded electric cable 36 that has been prepared for attachment of the shielded electric terminal 10. Cable 36 has a conductive core 38, an inner insulation layer 40 surrounding the conductive core 38, an intermediate conductive layer 42 surrounding the inner insulation layer 40 and an outer insulation jacket 44 surrounding the intermediate conductive layer 42.

To prepare shielded electric cable 36 for attachment to the shielded electric terminal 10, the end portion of the cable 36 is cut circumferentially at three axially spaced locations with the cuts successively deeper into the cable 36 so that three end portions can be stripped away.

The first cut, which is furthest from the end of the cable, is through the outer insulation jacket 44 so that an elongate end portion can be stripped away to provide an exposed end portion of the intermediate conductive layer 42 as shown in FIG. 2. The second cut extends through the intermediate conductive layer so that an end portion can be stripped away to provide an exposed end portion of the inner insulation layer 40. The third cut, which is closest to the end of the shielded electric cable extends through the inner insulation layer 40 so that an end portion can be stripped away to provide exposed end portion of the conductive core 38.

Figure 6:
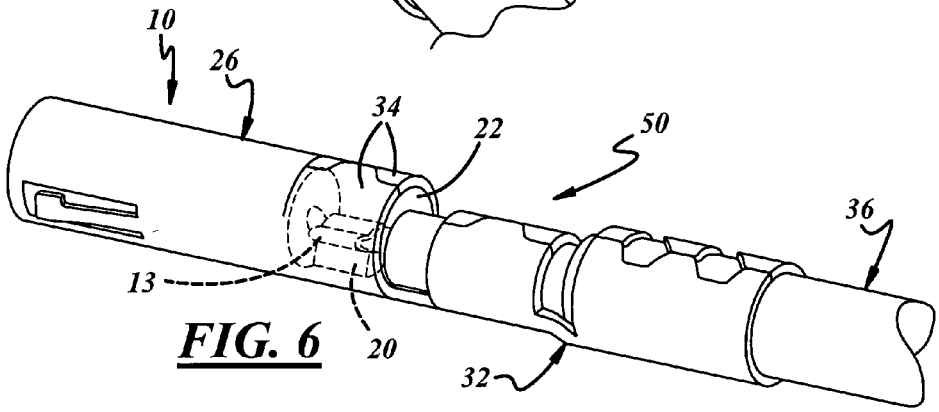
FIG. 6 is a perspective of the shielded electric connector assembly that is shown in FIGS. 3, 4 and 5 after completion.

After the shielded electric cable 36 is prepared as discussed above, the cable 36 is attached to the shielded electric terminal 10 to form a shielded electric cable assembly 50 shown in FIG. 6.

The shielded electric cable assembly 50 comprises shielded electric connector 10 and shielded electric cable 36. The shielded electric cable assembly 50 may be made in accordance with a method of the invention using the shielded electric connector 10 and the shielded electric cable 36; the method being illustrated and explained in connection with FIGS. 3, 4 and 5.

Figure 3:
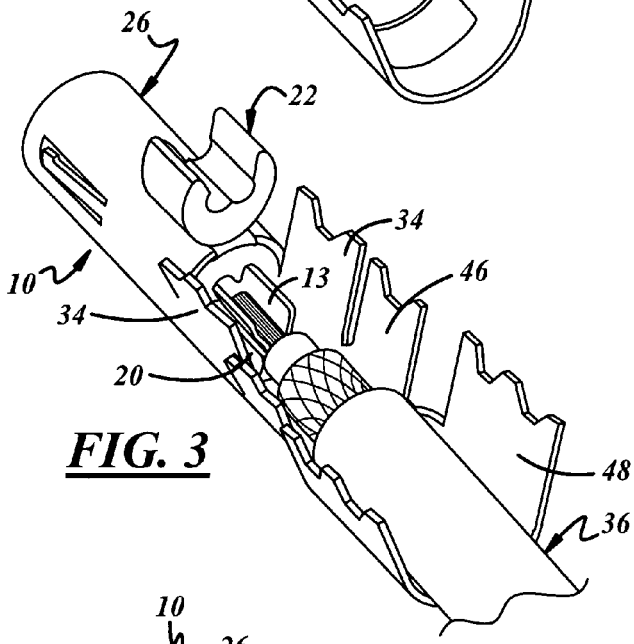
FIGS. 3 and 4 are perspective views of a shielded electric cable assembly that embodies the invention in the process of being manufactured in accordance with a method of the invention.

After providing shielded electric connector 10, FIG. 1 and shielded electric cable 36, FIG. 3, the exposed end portion of the conductive core 38 of the shielded electric cable 36 is inserted into the bay 30 of the outer terminal 26 and supported on the rearward attachment portion 13 of the inner terminal 12 which in turn is supported on the anvil 20 of the insulator 16 as shown in FIG. 3. The exposed end of the intermediate conductive layer 42 is also preferably supported on an open forward crimp barrel 46 of the outer terminal 26 while an end portion of the outer insulation jacket 44 of the coaxial cable 36 is supported on an open rearward crimp barrel 48 of the outer terminal 26.

Figure 4:
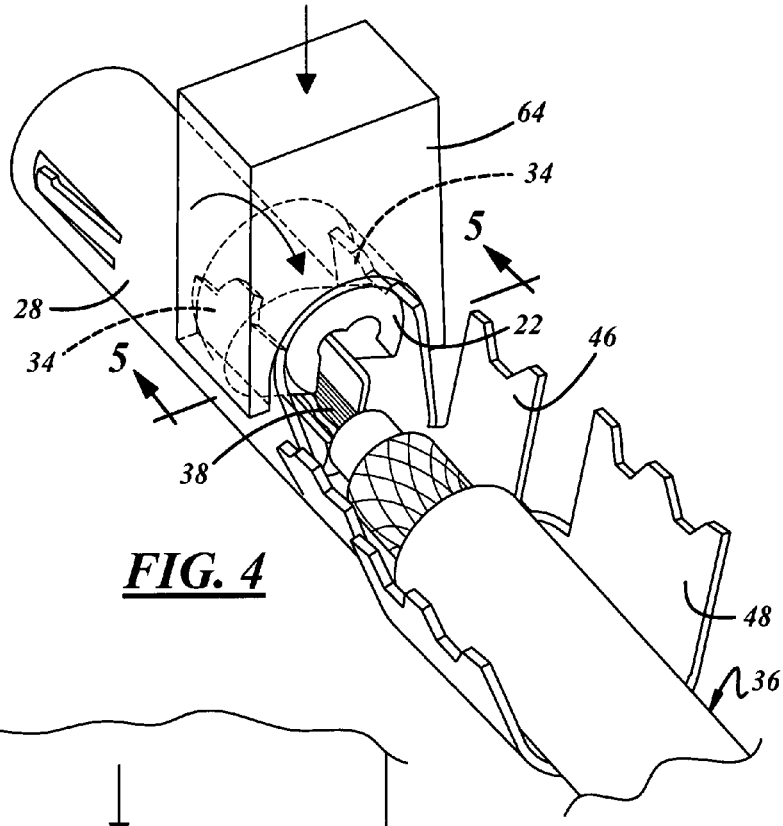
Figure 5:
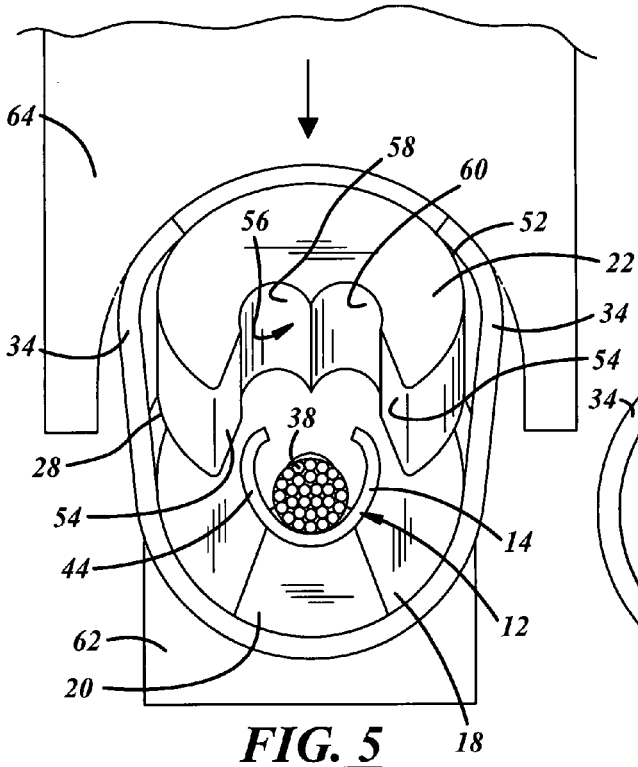
FIG. 5 is a section taken substantially along the line 5-5 of FIG. 4 looking in the direction of the arrows.

The integrally attached crimp tool 22 of the insulator 16 is then folded over from the position above the outer terminal 26 shown in FIG. 3 to a position embracing the core crimp wings 14 of the inner terminal 12 as best shown in FIGS. 4 and 5. Crimp tool 22 has a cylindrical outer surface 52 that has a diameter that is substantially equal to the inner diameter of the forward housing 28 of the outer shielding terminal 26. The inner surface of the integrally attached crimp tool 22 has converging side walls 54 and a central forming wall 56 comprising adjacent vaults 58 and 60.

Figure 7:
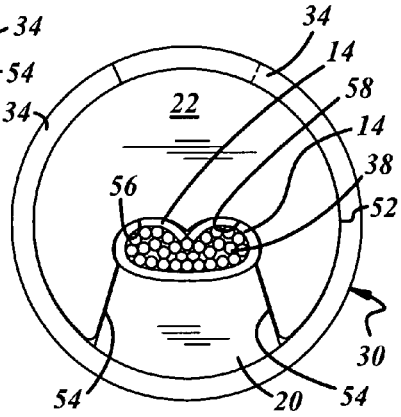
FIG. 7 is a section taken substantially along the line 7-7 of FIG. 6 looking in the direction of the arrows.

The side wall flaps 34 are then crimped in a crimping apparatus comprising a support anvil 62 and a moveable crimp plate 64 as shown in FIGS. 4 and 5. More specifically, as the crimp plate 64 moves downwardly toward the support anvil 62 as indicated by the arrow in FIGS. 4 and 5, the crimp plate 64 engages the end portions of the side wall flaps 34 curling the side wall flaps 34 inwardly into engagement with the outer cylindrical surface of the crimp tool 22. As the crimp plate 64 continues its downward movement, the crimp tool 22 moves downwardly with the crimp plate 64. The converging side walls 54 of the crimp tool 22 initially engage the core crimp wings 14 of the inner terminal 12 and direct the core crimp wings 14 into the central forming wall 56 where the adjacent vaults 58 and 60 crimp the core crimp wings 14 tightly around the exposed end of the conductive core 38 of the shielded electric cable 36 as shown in FIG. 7. In the mean time, the crimp plate 64 forms the side wall flaps 34 around the outer cylindrical surface 52 of the crimp tool 22 moving the side wall flaps 34 from the open position shown in FIG. 1 to a completely closed position shown in FIGS. 6 and 7 where the crimp tool 22 is enclosed in the closed bay 30 of the outer terminal 26.

The converging side walls 54 of the crimp tool 22 preferably engage or lie very close to the respective side walls of the anvil 20 when the side wall flaps 34 are closed as best shown in FIG. 7.

In reference to FIG. 6 the shielded electric cable assembly 50 may be completed by attaching the outer terminal 26 to the shielded electric cable 36 in any suitable manner. For instance, the outer terminal 26 may be attached to the shielded electric cable 36 by crimping the open crimp barrels 46 and 48 tightly around the ends of the intermediate conductive layer 42 and the outer insulation jacket 44 respectively in a conventional crimping operation. This may be done simultaneously with closing the bay 30 of the outer shielding terminal 26 or in a secondary crimping operation that is either before or after the closure of the bay 30.

Thus the shielded electric cable assembly 50 has an inner terminal 12 that is completely surrounded by an outer shielding terminal 26 from end-to-end resulting in a very efficient shielding arrangement. Moreover the shielded electric cable assembly 50 is made by a method that is neither complicated nor expensive.

While the exemplary method of the invention has been described in connection with the die plate 64 moving downward with respect to the support anvil 62, it should be understood that any relative movement will suffice. In other words, the crimp plate 64 can be stationery and the support anvil 62 moveable upwardly toward a stationery crimp plate 64.

Figure 8:
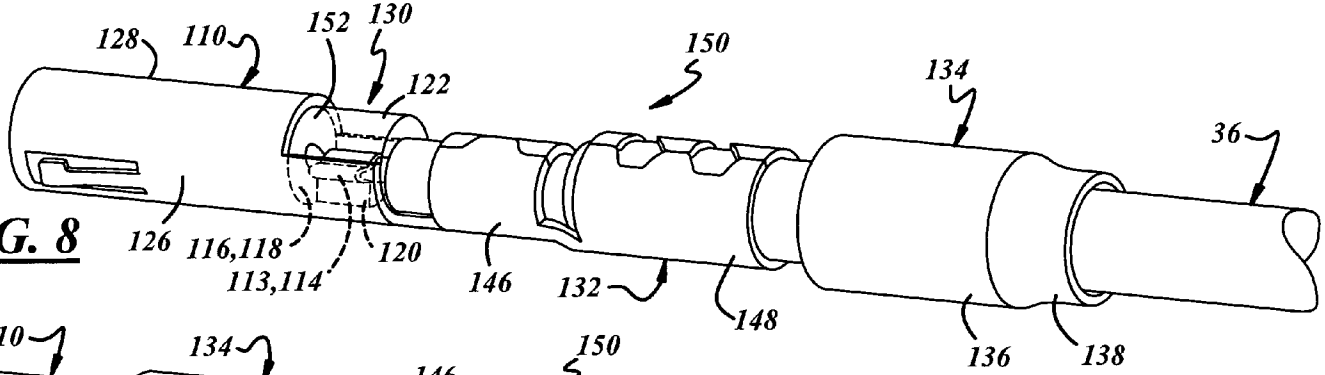
FIG. 8 is a perspective view of another shielded electric cable assembly that embodies the invention in the process of being manufactured.

Referring now to FIG. 8 another shielded electric cable assembly 150 that embodies the invention is illustrated in the process of being manufactured. The shielded cable assembly 150 comprises a shielded electric terminal 110 and a shielded electric cable 36 that is illustrated in FIG. 2.

Figure 9:
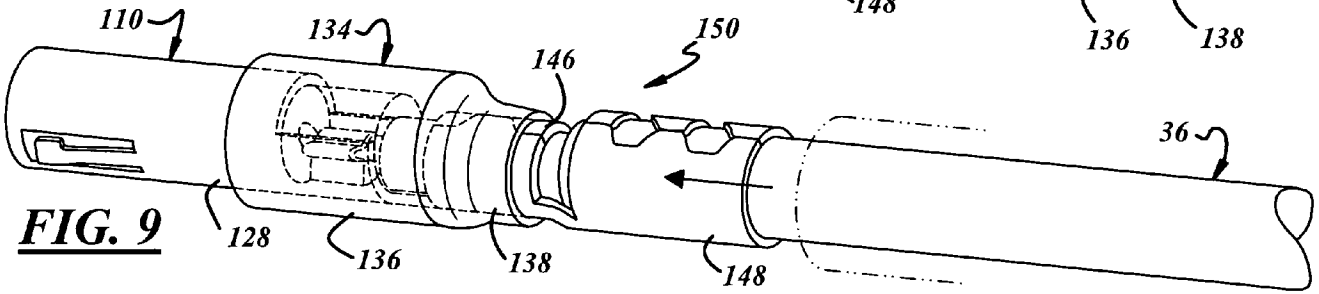
FIG. 9 is a perspective of the shielded electric connector assembly of FIG. 8 after completion.

As shown in FIGS. 8 and 9, the shielded electric connector 110 comprises an inner terminal having a forward contact portion and a rearward attachment portion 113 that includes core crimp wings 114, an insulator 116 having a forward housing 118, and a rearward anvil 120 that that projects from a rearward end of the housing 118 in a fixed manner, and a crimp tool 122 that is attached to the rearward end of the housing by a hinge as in the case of first embodiment shown in FIGS. 1-7. The forward contact portion of the inner terminal is disposed in the forward housing 118 of the insulator 116 with the rearward attachment portion of the inner terminal being supported on the rearward anvil 120 of the insulator 116.

Cable assembly 150 includes an outer shielding terminal 126 having a forward housing 128, an intermediate bay 130, and a rearward attachment portion 132. The forward housing 118 of the insulator 116 is disposed in the forward housing 128 of the outer shielding terminal 126 while the rearward attachment portion 113 of the inner terminal 112 and the rearward anvil 120 of the insulator 116 are disposed in the intermediate bay 130 of the outer shielding terminal 126. The intermediate bay 130 of the outer shielding terminal 126 has an opening for receiving the crimp tool 122 of the insulator 116 as shown in FIG. 8. The intermediate bay 130 of the shielded electric connector 110 does not have any side wall flap or flaps for enclosing the crimp tool 122 in the intermediate bay 130. A separate closure shell 134 is provided for this purpose as explained below.

During manufacture of cable assembly 150, the integrally attached crimp tool 122 of the insulator 116 which is identical to crimp tool 122 is folded over from a position above the outer terminal 126 as shown in FIG. 3 to a position embracing the core crimp wings 114 of the inner terminal 112 as best shown in FIGS. 4 and 5. Crimp tool 122 has a cylindrical outer surface 152 that has a diameter that is substantially equal to the inner diameter of the forward housing 128 of the outer shielding terminal 126 as shown in FIG. 8. The inner surface of the integrally attached crimp tool 122 like crimping tool 22 has converging side walls and a central forming wall comprising adjacent vaults.

The crimp wings 114 are then crimped in a crimping apparatus comprising a support anvil and a moveable crimp plate the moves toward the support anvil engaging the outer cylindrical surface 152 of the crimp tool 122 and moving the crimp tool 122 downward directing the core crimp wings 114 into the central forming wall of the crimp tool 122 where the adjacent vaults crimp the core crimp wings 114 tightly around the exposed end of the conductive core 38 of the shielded electric cable 36 as shown in FIG. 8.

The converging side walls of the crimp tool 122 preferably engage or lie very close to the respective side walls of the anvil 120 after the core crimp wings 114 are crimped tightly around the exposed end of the conductive core 38 of the shielded electric cable 36.

The shielded electric cable assembly 150 may be completed by attaching the outer terminal 126 to the shielded electric cable 36 in any suitable manner as shown in FIG. 8 and then attaching the closure shell 132 to the outer terminal 126 as shown in FIG. 9. For instance, the outer terminal 126 may be attached to the shielded electric cable 36 by crimping open crimp barrels 146 and 148 tightly around the ends of the intermediate conductive layer 42 and the outer insulation jacket 44 respectively in a conventional crimping operation. This may be done simultaneously with crimping core crimp wings 114 to cable core 38 or in a secondary crimping operation that is either before or after the core crimp wings 114 are crimped. In any event, after the wings 114 and the barrels 146 and 148 are crimped the closure shell 134 is moved from an initial pre-assembly position on cable 36 that is aft of the shielded electric connector 110 as shown in FIG. 8 to an assembled position on the shielded electric connector 110 that is shown in FIG. 9.

Closure shell 134 comprises a cylindrical housing 136 at one end and an attachment collar 138 at an opposite end. The cylindrical housing 136 fits on the end of the outer terminal housing 128 preferably with a close sliding fit while the attachment collar 138 has an inner diameter that is large enough to pass over the closed crimp barrel 148 that is attached to the outer insulation jacket 144 of shielded electric cable 36. As closure shell 134 is moved from the preassembled position of FIG. 8 to the assembled position of FIG. 9 cylindrical housing 138 slides onto the end of housing 128 until the open bay 130 is closed and the attachment collar 138 is aligned with the closed crimp barrel 146 that is attached to the intermediate conductive layer 42 of cable 36. Attachment collar 138 is then crimped to the closed crimp barrel 146 by reducing the diameter of the attachment collar 138 to fit tightly around the closed crimp barrel 146.

Thus the shielded electric cable assembly 150 has an inner terminal 112 that is completely surrounded by an outer shielding terminal 126 and closure shell 134 from end-to-end resulting in a very efficient shielding arrangement. Moreover the shielded electric cable assembly 150 is made by a method that is neither complicated nor expensive.

Figure 10:
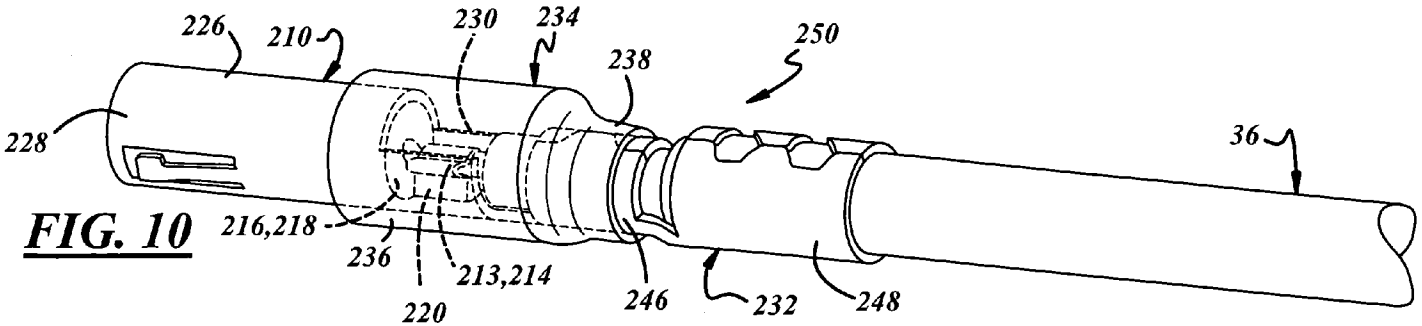
FIG. 10 is a perspective view of yet another shielded electric cable assembly that embodies the invention.

Referring now to FIG. 10 yet another shielded electric cable assembly 250 that embodies the invention is illustrated. The shielded cable assembly 250 comprises a shielded electric connector 210 and a shielded electric cable 36 that is illustrated in FIG. 2.

As shown in FIG. 10, the shielded electric connector 210 comprises an inner terminal having a forward contact portion and a rearward attachment portion 213 that includes core crimp wings 214, an insulator 216 having a forward housing 218, and a rearward anvil 220 that that projects from a rearward end of the housing in a fixed manner. The forward contact portion of the inner terminal 212 is disposed in the forward housing 218 of the insulator 216 with the rearward attachment portion 213 of the inner terminal being supported on the rearward anvil 220 of the insulator 216.

Cable assembly 250 includes an outer shielding terminal 226 having a forward housing 228, an intermediate bay 230, and a rearward attachment portion 232. The forward housing 218 of the insulator 216 is disposed in the forward housing 228 of the outer shielding terminal 226 while the rearward attachment portion 213 of the inner terminal 212 and the rearward anvil 220 of the insulator 216 are disposed in the intermediate bay 230 of the outer shielding terminal 226. The intermediate bay 230 of the outer shielding terminal 226 has an opening for receiving a crimp tool (not shown). The intermediate bay 230 of the shielded electric connector 210 does not have any side wall flap or flaps for closing the intermediate bay 230. A separate closure shell 234 is provided for this purpose as explained below.

During manufacture of cable assembly 250, the crimp wings 214 are crimped in a conventional crimping apparatus comprising a support anvil and a moveable crimp plate that moves into the intermediate bay 230 toward the support anvil engaging the core crimp wings 114 and crimping the core crimp wings 114 tightly around the exposed end of the conductive core 38 of the shielded electric cable 36 as shown in FIG. 10.

The shielded electric cable assembly 250 may be completed by attaching the outer terminal 226 to the shielded electric cable 36 in any suitable manner and then attaching the closure shell 232 to the outer terminal 226 as shown in FIG. 10. For instance, the outer terminal 226 may be attached to the shielded electric cable 36 by crimping open crimp barrels 246 and 248 tightly around the ends of the intermediate conductive layer 42 and the outer insulation jacket 44 respectively in a conventional crimping operation. This may be done simultaneously with crimping core crimp wings 214 to cable core 38 or in a secondary crimping operation that is either before or after the core crimp wings 214 are crimped. In any event, after these crimping operations the closure shell 234 is moved from an initial pre-assembly position on cable 36 that is aft of the shielded electric connector as shown in connection with the cable assembly 150 of FIG. 8 to an assembled position on the shielded electric connector 210 that is shown in FIG. 10.

Closure shell 234 comprises a cylindrical housing 236 at one end and an attachment collar 238 at an opposite end. The cylindrical housing 236 fits on the end of the outer terminal housing 228 preferably with a close sliding fit while the attachment collar 238 has an inner diameter that is large enough to pass over the closed crimp barrel 248 that is attached to the outer insulation jacket 44 of coaxial cable 36. As closure shell 234 is moved to the assembled position of FIG. 10 cylindrical housing 238 slides onto the end of housing 228 until the open bay 230 is closed and the attachment collar 238 is aligned with the closed crimp barrel 246 that is attached to the intermediate conductive layer 42 of cable 36. Attachment collar 238 is then crimped to the closed crimp barrel 246 by reducing the diameter of the attachment collar 238 to fit tightly around the closed crimp barrel 246.

Thus the shielded electric cable assembly 250 has an inner terminal 212 that is completely surrounded by an outer shielding terminal 226 and closure shell 234 from end-to-end resulting in a very efficient shielding arrangement. Moreover the shielded electric cable assembly 250 is made by a method that is neither complicated nor expensive.

Thus the shielded electric connector and assembly of the invention and method of making the same may be realized in a variety of ways.

In other words, it is readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. A shielded electric connector comprising:

an inner terminal having a forward contact portion and a rearward attachment portion that includes core crimp wings, an insulator having a forward housing and a rearward anvil that projects from a rearward end of the housing in a fixed manner, the forward contact portion of the inner terminal being disposed in the forward housing of the insulator with the rearward attachment portion of the inner terminal being supported on the rearward anvil of the insulator, and an outer shielding terminal having a forward housing, an intermediate bay, and a rearward attachment portion, the forward housing of the insulator being disposed in the forward housing of the outer shielding terminal with the rearward attachment portion of the inner terminal and the rearward anvil of the insulator being disposed in the intermediate bay of the outer shielding terminal the intermediate bay of the outer shielding terminal having an opening for receiving a crimp tool, and means for closing the opening of the intermediate bay of the outer shielding terminal wherein the crimp tool is attached to the rearward end of the forward housing of the insulator by a hinge.

2. The shielded electric connector of claim 1 wherein the means for closing the intermediate bay of the outer shielding terminal includes at least one side wall flap of the intermediate bay.

3. The shielded electric connector of claim 1 wherein the means for closing the intermediate bay of the outer shielding terminal is a closure shell.

4. The shielded electric connector of claim 1 wherein the means for closing the intermediate bay of the outer shielding terminal includes at least one side wall flap of the intermediate bay.

5. The shielded electric connector of claim 1 wherein the means for closing the intermediate bay of the outer shielding terminal is a closure shell.

6. A shielded electric connector comprising:

an inner terminal having a forward contact portion and a rearward attachment portion that includes core crimp wings, an insulator having a forward housing, a rearward anvil that projects from a rearward end of the housing in a fixed manner, and a crimp tool that is attached to the rearward end of the housing by a hinge, the forward contact portion of the inner terminal being disposed in the forward housing of the insulator with the rearward attachment portion of the inner terminal being supported on the rearward anvil of the insulator, and an outer shielding terminal having a forward housing, an intermediate bay, and a rearward attachment portion, the forward housing of the insulator being disposed in the forward housing of the outer shielding terminal with the rearward attachment end of the inner terminal and the rearward anvil of the insulator being disposed in the intermediate bay of the outer shielding terminal, and the intermediate bay of the outer shielding terminal having an opening for receiving the crimp tool of the insulator and side wall flaps for enclosing the crimp tool in the intermediate bay.

7. A shielded electric cable assembly comprising:

a shielded electric cable and a shielded electric connector, the shielded electric cable having a conductive core, an inner insulation layer surrounding the core, a intermediate conductive layer surrounding the inner insulation layer, and an outer insulation jacket surrounding the intermediate conductive layer, the shielded electric connector having an inner terminal, an insulator and an outer shielding terminal, the inner terminal having a forward contact portion and a rearward attachment portion that includes core crimp wings that are attached to the conductive core of the shielded electric cable, the insulator having a forward housing and a rearward anvil that projects from a rearward end of the housing in a fixed manner, the forward contact portion of the inner terminal being disposed in the forward housing of the insulator with the rearward attachment portion of the inner terminal being supported on the rearward anvil of the insulator, and the outer shielding terminal having a forward housing, an intermediate bay, and a rearward attachment portion, the forward housing of the insulator being disposed in the forward housing of the outer shielding terminal with the rearward attachment portion of the inner terminal and the rearward anvil of the insulator being disposed in the intermediate bay of the outer shielding terminal, the intermediate bay of the outer terminal having an opening for receiving a crimp tool, and means for closing the intermediate bay of the outer shielding terminal wherein the crimp tool is attached to the rearward end of the forward housing of the insulator by a hinge.

8. The shielded electric cable assembly of claim 7 wherein the means for closing the intermediate bay of the outer shielding terminal includes at least one side wall flap of the intermediate bay.

9. The shielded electric cable assembly of claim 7 wherein the means for closing the intermediate bay of the outer shielding terminal is a closure shell.

10. The shielded electric cable assembly of claim 7 wherein the means for closing the intermediate bay of the outer shielding terminal includes at least one side wall flap of the intermediate bay.

11. The shielded electric cable assembly of claim 7 wherein the means for closing the intermediate bay of the outer shielding terminal is a closure shell.

12. The shielded electric cable assembly of claim 11 wherein the rearward attachment portion of the outer shielding terminal has forward crimp wings attached to the intermediate conductive layer of the shielded electric cable and rearward crimp wings attached to the outer insulation jacket of the shielded electric cable and wherein the closure shell has a cylindrical portion at one end that fits onto the forward housing of the outer shielding terminal and a collar at an opposite end that is attached to the forward crimp wings of the outer shielding terminal.

13. A method of making shielded electric cable assembly having a shielded electric connector attached to an end of a shielded electric cable having a inner conductive core, an inner insulation layer surrounding the conductive core, an intermediate conductive layer surrounding the inner insulation layer, and an outer insulation jacket surrounding the intermediate conductive layer, the method comprising:

providing a shielded electric connector having an inner terminal, an insulator and an outer shielding terminal, the inner terminal having a forward contact portion and a rearward attachment portion that includes core crimp wings, the insulator having a rearward anvil that that projects from a rearward end of a forward housing in a fixed manner, the rearward attachment portion of the inner terminal being supported on the rearward anvil of the insulator, and the outer shielding terminal having an intermediate bay in which the rearward attachment portions of the inner terminal and the rearward anvil of the insulator are disposed, the intermediate bay of the outer shielding terminal having an opening for receiving a crimp tool, and means for closing the opening of the intermediate bay, supporting an exposed end portion of the conductive core of the shielded electric cable on the rearward attachment portion of the inner terminal, placing the crimp tool on the core crimp wings of the inner terminal and crimping the rearward attachment portion of the inner terminal onto the conductive core of the shielded electric cable, and closing the opening of the intermediate bay of the outer shielding terminal wherein the crimp tool is attached to the rearward end of the forward housing of the insulator by a hinge.

14. The method of claim 13 wherein the intermediate bay of the outer shielding terminal is closed by at least one side wall flap of the intermediate bay.

15. The method of claim 13 wherein the intermediate bay of the outer shielding terminal is closed by a closure shell.

16. The method of claim 13 wherein the intermediate bay of the outer shielding terminal is closed by at least one side wall flap of the intermediate bay and wherein the outer shielding terminal has a rearward attachment portion that includes forward crimp wings attaching the outer shielding terminal to the intermediate conductive layer of the shielded electric cable, and rearward crimp wings attaching the outer shielding terminal to the outer insulation jacket of the shielded electric cable.

17. The method of claim 13 wherein the intermediate bay of the outer shielding terminal is closed by a closure shell, wherein the outer shielding terminal has a rearward attachment portion that includes forward crimp wings attaching the outer shielding terminal to the intermediate conductive layer of the shielded electric cable and rearward crimp wings attaching the outer shielding terminal to the outer insulation jacket of the shielded electric cable, and wherein the closure shell has a cylindrical portion at one end that fits onto the forward housing of the outer shielding terminal and a collar at an opposite end that is attached to the forward crimp wings of the outer shielding terminal.

* * * * *